US011628485B2

(12) United States Patent
Eberl et al.

(10) Patent No.: US 11,628,485 B2
(45) Date of Patent: Apr. 18, 2023

(54) TOOLING ASSEMBLY AND METHOD FOR EXPLOSIVELY FORMING FEATURES IN A THIN-WALLED CYLINDER

(71) Applicant: BATTELLE SAVANNAH RIVER ALLIANCE, LLC, Aiken, SC (US)

(72) Inventors: Kurt R. Eberl, Aiken, SC (US); William M. Housley, Aiken, SC (US); James M. Shuler, Germantown, MD (US); Paul S. Blanton, Aiken, SC (US); Joshua P. Flach, Aiken, SC (US)

(73) Assignee: Battelle Savannah River Alliance, LLC., Aiken, SC (US)

( * ) Notice: Subject to any disclaimer, the term of this patent is extended or adjusted under 35 U.S.C. 154(b) by 0 days.

(21) Appl. No.: 17/320,523

(22) Filed: May 14, 2021

(65) Prior Publication Data

US 2022/0362829 A1 Nov. 17, 2022

(51) Int. Cl.
*B21D 26/08* (2006.01)
*B21D 51/10* (2006.01)

(52) U.S. Cl.
CPC ..... *B21D 26/08* (2013.01); *B21D 51/10* (2013.01)

(58) Field of Classification Search
CPC ..... B21D 26/06; B21D 26/08; B21D 26/10; B21D 26/12; B21D 26/059; B21D 26/051; B21D 26/047
See application file for complete search history.

(56) References Cited

U.S. PATENT DOCUMENTS 3,156,973 A 11/1964 Lieberman et al.
3,566,648 A * 3/1971 Norin et al. ..... B21D 26/12 29/421.2

(Continued)

FOREIGN PATENT DOCUMENTS

FR 1 416 098 A 10/1965
GB 392635 5/1933

(Continued)

OTHER PUBLICATIONS

Noland, et al. "High-Velocify Metalworking: A Survey" *NASA* SP-5062 (1967) pp. 1-188.

(Continued)

*Primary Examiner* — Debra M Sullivan
(74) *Attorney, Agent, or Firm* — Dority & Manning, P.A.

(57) ABSTRACT

The present invention provides a method of explosively forming a helical tube from at least one thin-walled cylinder using a tooling assembly. The method includes inserting the at least one thin-walled cylinder into a die of the tooling assembly. The die surrounds the at least one thin-walled cylinder and includes an interior surface that defines a helical thread pattern. The method further includes surrounding the at least one thin-walled cylinder and the die with a casing of the tooling assembly. A cavity is defined by the casing and the thin-walled cylinder. The method further includes positioning an explosive charge within the cavity. The method additionally includes at least partially submerging the tooling assembly. The method further includes detonating the explosive charge. As a result, the at least one thin-walled cylinder is formed into a helical tube that corresponds with helical thread pattern of the interior surface of the die.

18 Claims, 7 Drawing Sheets

(56) References Cited

U.S. PATENT DOCUMENTS

| | | | | |
|---|---|---|---|---|
| 3,572,072 | A * | 3/1971 | Hundley | B21D 26/12 29/421.2 |
| 3,611,767 | A | 10/1971 | Berman et al. | |
| 3,759,551 | A | 9/1973 | Broske | |
| 3,863,327 | A | 2/1975 | Legate et al. | |
| 3,958,437 | A | 5/1976 | Barorian | |
| RE30,380 | E | 8/1980 | Shrum | |
| 4,220,027 | A | 9/1980 | Johnson et al. | |
| 6,305,204 | B1 | 10/2001 | Tauzer | |
| 8,713,982 | B2 | 5/2014 | Stranz et al. | |
| 9,296,030 | B2 | 3/2016 | Stranz et al. | |

FOREIGN PATENT DOCUMENTS

| | | |
|---|---|---|
| GB | 878178 A | 9/1961 |
| GB | 1177017 | 1/1970 |
| GB | 1218116 | 1/1971 |
| GB | 1562387 | 3/1980 |

OTHER PUBLICATIONS

Strohecker, et al. "Explosive Forming of Metals" *Battelle Mem. Inst*. 203 (1964) pp. 1-68.

International Search Report and Written Opinion for PCT/US2022/027266, dated Jul. 28, 2022, 7 pages.

* cited by examiner

TOOLING ASSEMBLY AND METHOD FOR EXPLOSIVELY FORMING FEATURES IN A THIN-WALLED CYLINDER

FEDERAL RESEARCH STATEMENT

This invention was made with Government support under Contract No. DE-AC09-08SR22470, awarded by the U.S. Department of Energy. The Government has certain rights in the invention.

FIELD OF THE INVENTION

The subject matter of the present disclosure relates generally to a method and tooling assembly for forming features in a thin-walled cylinder.

BACKGROUND OF THE INVENTION

Containers and associated systems used to store and ship radioactive materials must be designed and demonstrated to safely contain the radioactive materials and limit personnel exposure, both under normal conditions and in a variety of accident scenarios. For example, the containers and associated systems may be subjected to a variety of tests demonstrating the ability to withstand normal conditions of transport, e.g., water spray test, free drop test, penetration test, compression test, or others, without the loss of any radioactive contents.

Generally, these engineered containers are in the form of cylindrically shaped drums that are used to confine the radioactive material for the purposes of transportation and storage. These engineered containers are typically referred to as "packagings" and must be secured in a way that provides adequate confinement of the radioactive material. Typically, the ends of the drums are closed, utilizing standard bolted drum closure rings or comprising sufficient welded fittings and bolts to provide an adequate level of integrity for the package to meet safety and testing regulations required to ship radioactive material. The use of standard drum closure rings or machined fittings welded to the drumhead as a method for closing the packagings can be expensive to produce and requires specialized tools, e.g., calibrated wrenches, to operate. Additionally, packagings fastened utilizing closure rings or welded fittings and bolts do not include integral features to increase the capability of the drum to withstand hypothetical accident conditions required by safety regulations for radioactive material transport. Since the location of the closure rings and bolted closures are typically on the top surface of the drum, they are easily damaged and vulnerable to damage that could release radioactive material. Operation of drums closed with bolted closures requires specific closure instructions and tools to be used and involve the handling of many fasteners. Additionally, operation of drums closed with bolted closures typically require more time to close, which may expose the operator to increased doses of radiation.

As such, a tooling assembly and method for forming features in a thin-walled cylinder would be useful. In particular, a tooling assembly and method for forming features in multiple thin-walled cylinders simultaneously would be useful. Such a tooling assembly and method that produce features within the thin-walled cylinder that provide a closure mechanism capable of withstanding the conditions required for the transport and storage of radioactive material while reducing cost and improving transportation preparation efficiency and operator safety would be particularly beneficial.

BRIEF DESCRIPTION OF THE INVENTION

The present invention provides a method and tooling assembly for explosively forming at least one helical tube from a thin-walled cylinder, or explosively forming multiple helical tubes simultaneously from nested cylinders. As such, the present invention allows for the manufacture of a helical tube, which contains features particularly advantageous for the storage, shipping, and transportation of radioactive material. For example, the present invention provides the tooling and method necessary to create a helical tube that demonstrates increased performance in the regulatory tests required for the transportation of a radioactive material, e.g., free drop test, penetration test, compression test, crush test, pool fire test, or others, when compared to known structures. Since the present tooling assembly and method allows for multiple helical tubes to be manufactured at a time, the resulting multiple helical tubes may be threaded and coupled to one another as a result of the exemplary tooling assembly and method described herein. Additional aspects and advantages of the invention will be set forth in part in the following description, or may be apparent from the description, or may be learned through practice of the invention.

In one exemplary embodiment, the present invention provides a method of explosively forming a helical tube from at least one thin-walled cylinder using a tooling assembly. The method includes inserting the at least one thin-walled cylinder into a die of the tooling assembly. The internal features of the die component define a helical thread pattern. The method further includes surrounding the at least one thin-walled cylinder and the die with a casing of the tooling assembly. A cavity is defined by the casing and the thin-walled cylinder. The cavity contains design features that allow it to be sealed such that fluids from outside the cavity are prevented from entering the cavity. The method additionally includes sealings features that allows the tooling assembly to be partially or wholly submerged into water or other fluids. The method further includes positioning an explosive charge within the cavity. The method further includes detonating the explosive charge. As a result, the at least one thin-walled cylinder is formed into a helical tube that corresponds with helical thread pattern of the interior surface of the die. Furthermore, the tooling assembly has features that allows the formed thin-walled helical components to be removed from the tooling assembly.

In another exemplary embodiment, the tooling assembly for explosively forming a helical tube from at least one thin-walled cylinder includes features to define the axial, radial, and circumferential direction of the formed part. The tooling assembly includes a casing that surrounds the at least one thin-walled cylinder. The casing having a die support that extends from a first end to a second end and a tube sealing plate coupled to the first end of the die support. The tube sealing plate converges radially inward in the axial direction. The casing and the at least one thin-walled cylinder define a cavity that extends along an axial centerline of the tooling assembly. The tooling assembly further includes a die positioned within the casing. The die having a radially outer surface in contact with the die support of the casing and a radially inner surface that defines a helical thread pattern. The radially outer surface of the die and the radially inner surface of casing may be conical to facilitate removal of the at least one helically formed part from the die and the removal of the die from the casing.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of the same or similar reference numerals in the figures denotes the same or similar features.

DETAILED DESCRIPTION OF THE INVENTION

Figure 1:
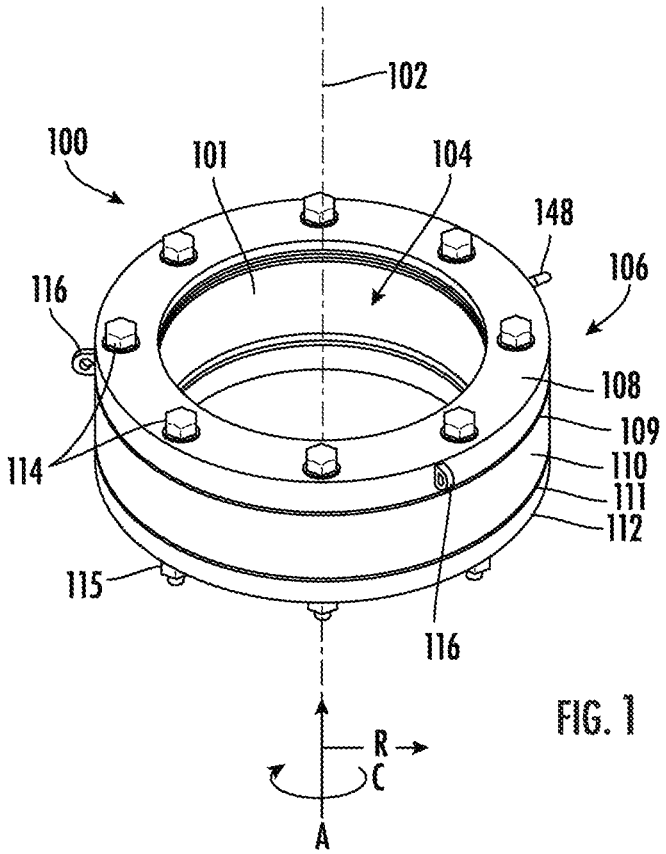
FIG. 1 is a perspective view of an exemplary embodiment of a tooling assembly of the present invention.

Reference now will be made in detail to embodiments of the present methods and systems, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The detailed description uses numerical and letter designations to refer to features in the drawings. Like or similar designations in the drawings and description have been used to refer to like or similar parts of the invention. As used herein, the terms "first", "second" and "third" may be used interchangeably to distinguish one component from another and are not intended to signify location or importance of the individual components.

As used herein, the term "radially" refers to the relative direction that is substantially perpendicular to an axial centerline of a particular component, the term "axially" refers to the relative direction that is substantially parallel and/or coaxially aligned to an axial centerline of a particular component (such as the axial centerline 102) and the term "circumferentially" refers to the relative direction that extends around the axial centerline of a particular component. Terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise.

Figure 2:
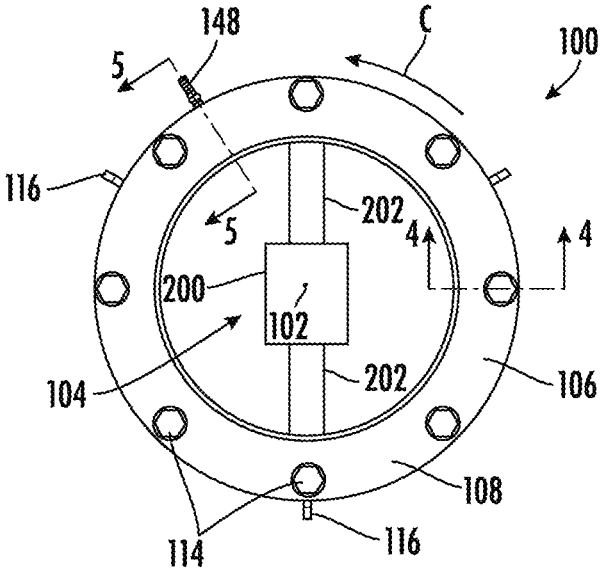
FIG. 2 is top view of the exemplary embodiment of FIG. 1.

Referring now to the drawings, FIG. 1 illustrates a perspective view of a tooling assembly 100, and FIG. 2 illustrates a top view of the tooling assembly 100, in accordance with embodiments of the present disclosure. As shown, the tooling assembly 100 may define an axial direction A substantially parallel to and/or along an axial centerline 102 of the tooling assembly 100, a radial direction R perpendicular to the axial centerline 102, and a circumferential direction C extending around the axial centerline 102.

Figure 7:
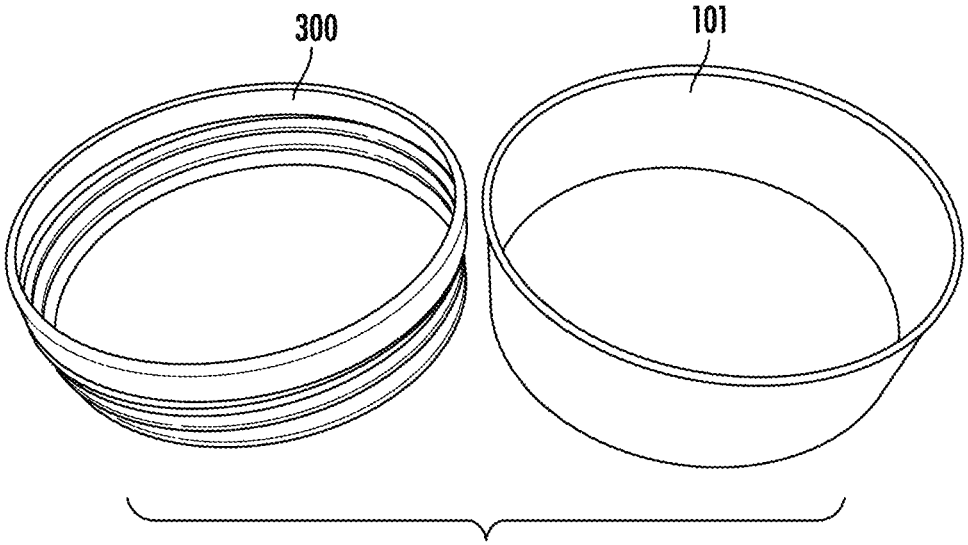
FIG. 7 is a thin-walled cylinder adjacent to a finished helical tube.

As shown in FIGS. 1 and 2, the tooling assembly 100 may be generally annularly shaped and may extend along the axial centerline 102, such that the tooling assembly 100 is generally shaped as a cylinder (in other embodiments, the tooling assembly may be rectangular). In this way, the tooling assembly 100 may define, central cavity or cavity 104 that extends along the axial centerline 102. During operation of the tooling assembly 100, an explosive charge 200 (such as dynamite or other suitable explosive) may be positioned within the cavity 104. When the explosive charge 200 is detonated within the cavity 104, one or more thin-walled cylinders 101 may expand and form into helical tubes 300 (FIG. 7). Many of the components described herein, e.g., the casing 106, the die 140, the at least one thin-walled cylinder 101, and others, may be annular components, such that they each extend circumferentially (or 360 degrees) around the axial centerline 102 (and the explosive charge 200) of the tooling assembly.

In many embodiments, the tooling assembly 100 may include a casing 106 that surrounds (e.g., circumferentially surrounds) one or more thin-walled cylinders 101. For example, as described below in more detail, the casing 106 may surround a radially outer surface, an axially inner end, and an axially outer end of the at least one thin-walled cylinders 101, such that the radially inner surface of the at least one thin-walled cylinder is the only exposed surface (e.g., exposed to ambient air and not covered by the casing 106). In particular, the radially inner surface of the at least one thin-walled cylinder 101 may be exposed to the cavity 104, thereby allowing an explosive charge to be positioned in the cavity for the formation of the thin-walled cylinder 101 into a helical tube 300.

In various embodiments, the casing 106 may include one or more portions bolted together by a plurality of bolts 114 and corresponding fasteners 115 (such as threaded nuts or threaded fasteners). For example, the plurality of bolts 114 may be circumferentially spaced apart from one another and may each extend generally axially through the casing 106. In particular embodiments, the casing 106 may include a tube sealing plate 108, a die support 110, and a base plate 112. The plurality of bolts 114 may extend through the tube sealing plate 108, the die support 110, and the base plate 112, and the corresponding fasteners 115 may threadably couple to the bolts 114 in order to couple the components of the casing 106 to one another. In many embodiments, the holes through which the plurality of bolts 114 extend through the casing 106 may not be threaded such that the bolts 114 only fasten to the corresponding fasteners 115, which may advantageously facilitate the disassembly of the casing 106 after the explosive forming. In particular embodiments, the die support 110 may extend axially between a first end 109 and a second end 111. The tube sealing plate 108 may be coupled to the first end 109 of the die support 110, and the base plate 112 may be coupled to the second end 111 of the die support 110.

In particular embodiments, the tooling assembly 100 may include one or more flanges or features 116 extending from the casing 106 in order to provide a means for the tooling assembly 100 to be lifted and transported, such as by a crane or forklift. The flanges 116 may extend from any portion of the casing 106, but, in exemplary embodiments, the flanges 116 may extend from the tube sealing plate 112.

Figure 3:
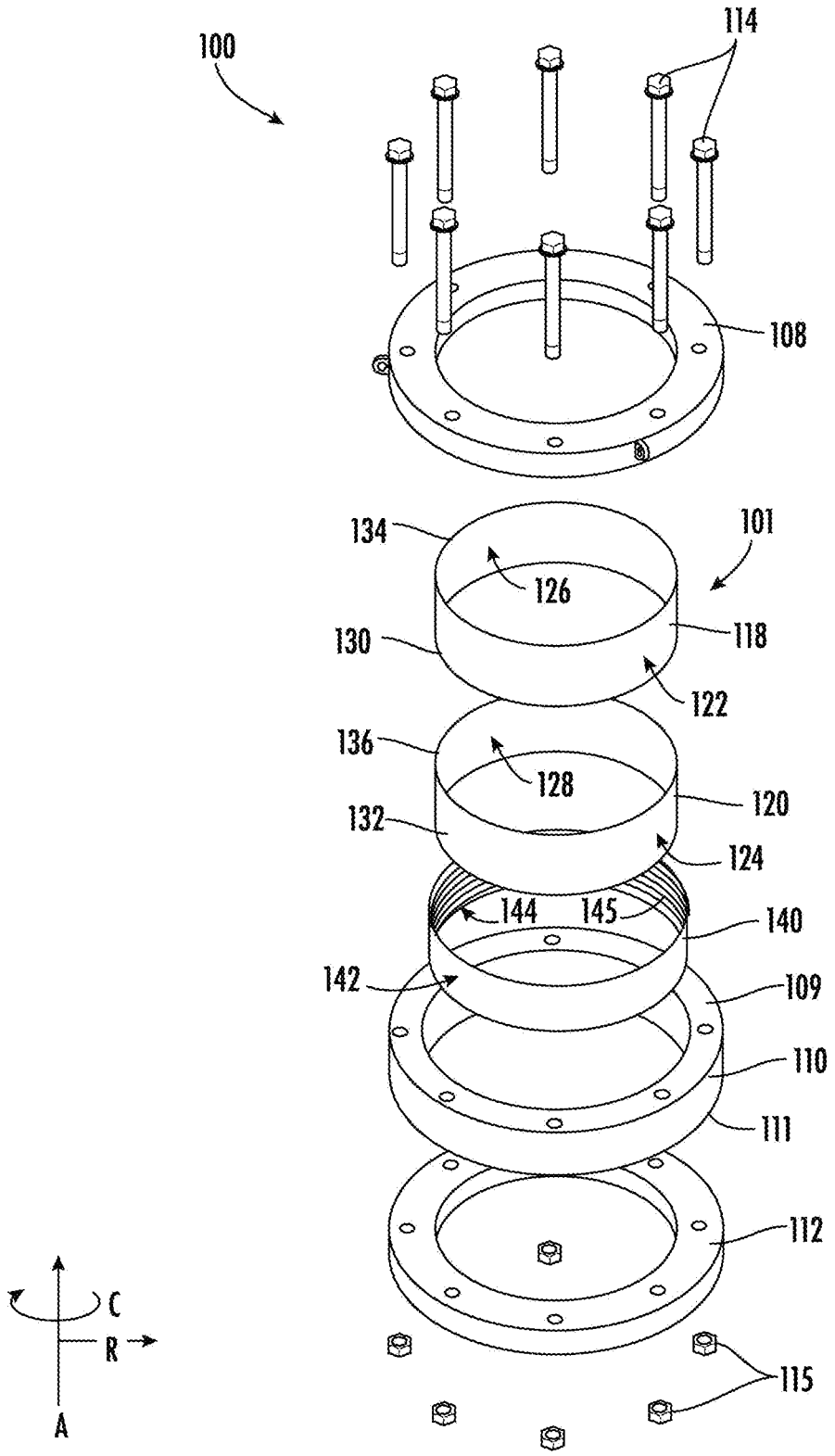
FIG. 3 is an exploded view of the exemplary embodiment of FIGS. 1 and 2.

FIG. 3 illustrates an exploded view of the tooling assembly 100 shown in FIGS. 1 and 2, in accordance with embodiments of the present disclosure. In many embodiments, the at least one thin-walled cylinder 101 may be an inner thin-walled cylinder 118 and an outer thin-walled cylinder 120. As shown, each of the thin-walled cylinders 118, 120 may include a radially outer surface 122, 124 and a radially inner surface 126, 128, and each of the thin-walled cylinders 118, 120 may extend axially between a first end 130, 132 and a second end 134, 136.

As should be understood, the radially inner surfaces 126, 128 of the thin-walled cylinders 118, 120 will each define an inner diameter of the thin-walled cylinders 118, 120, and the radially outer surfaces 122, 124 of the thin-walled cylinders 118, 120 will each define an outer diameter of the thin-walled cylinders 118, 120. As should be further understood, the thickness of the thin-walled cylinders 118, 120 may be calculated by subtracting the respective inner diameters from the respective outer diameters of the thin-walled cylinders 118, 120.

As used herein, the term "thin-walled cylinder" refers to cylinders having a specific thickness-to-diameter ratio. For example, in some embodiments, the thin-walled cylinders 118, 120 described herein may have a ratio of inner diameter-to-thickness of the of between about 50 and about 900. In other embodiments, the thin-walled cylinders 118, 120 described herein may have a ratio of inner diameter-to-thickness of the of between about 100 and about 800. In other embodiments, the thin-walled cylinders 118, 120 described herein may have a ratio of inner diameter-to-thickness of the of between about 200 and about 700. In particular embodiments, the thin-walled cylinders 118, 120 described herein may have a ratio of inner diameter-to-thickness of the of between about 300 and about 600.

As shown, the inner thin-walled cylinder 118 may have a slightly smaller outer diameter than the inner diameter of the outer thin-walled cylinder 120, such that the inner thin-walled cylinder 118 is able to fit inside of the outer thin-walled cylinder 120 within the tooling assembly 100. For example, as shown best in FIG. 4, the inner thin-walled cylinder 118 may be sized such that it fits inside and contacts the outer thin-walled 120, e.g., the radially outer surface 122 of the inner thin-walled cylinder 118 may contact the radially inner surface 128 of the outer thin-walled cylinder 120.

As shown in FIG. 3, the tooling assembly 100 may further include a die 140, which may be an annular component that surrounds both of the thin-walled cylinders 118, 120 when the tooling assembly 100 is fully assembled. The die 140 may be positioned within the casing 106 (FIG. 4) and may include a radially outer surface 142 that contacts the casing and a radially inner surface 144 that defines a helical thread pattern 145 (to which the thin-walled cylinders may at least partially be formed against during the explosive formation process). In exemplary implementations, the die 140 may be a removable, replaceable, or otherwise interchangeable component of the tooling assembly 100. In this way, the die 140 may be selected from a group of dies depending on the desired thread pattern or profile to which the thin-walled cylinders will be formed.

Figure 4:
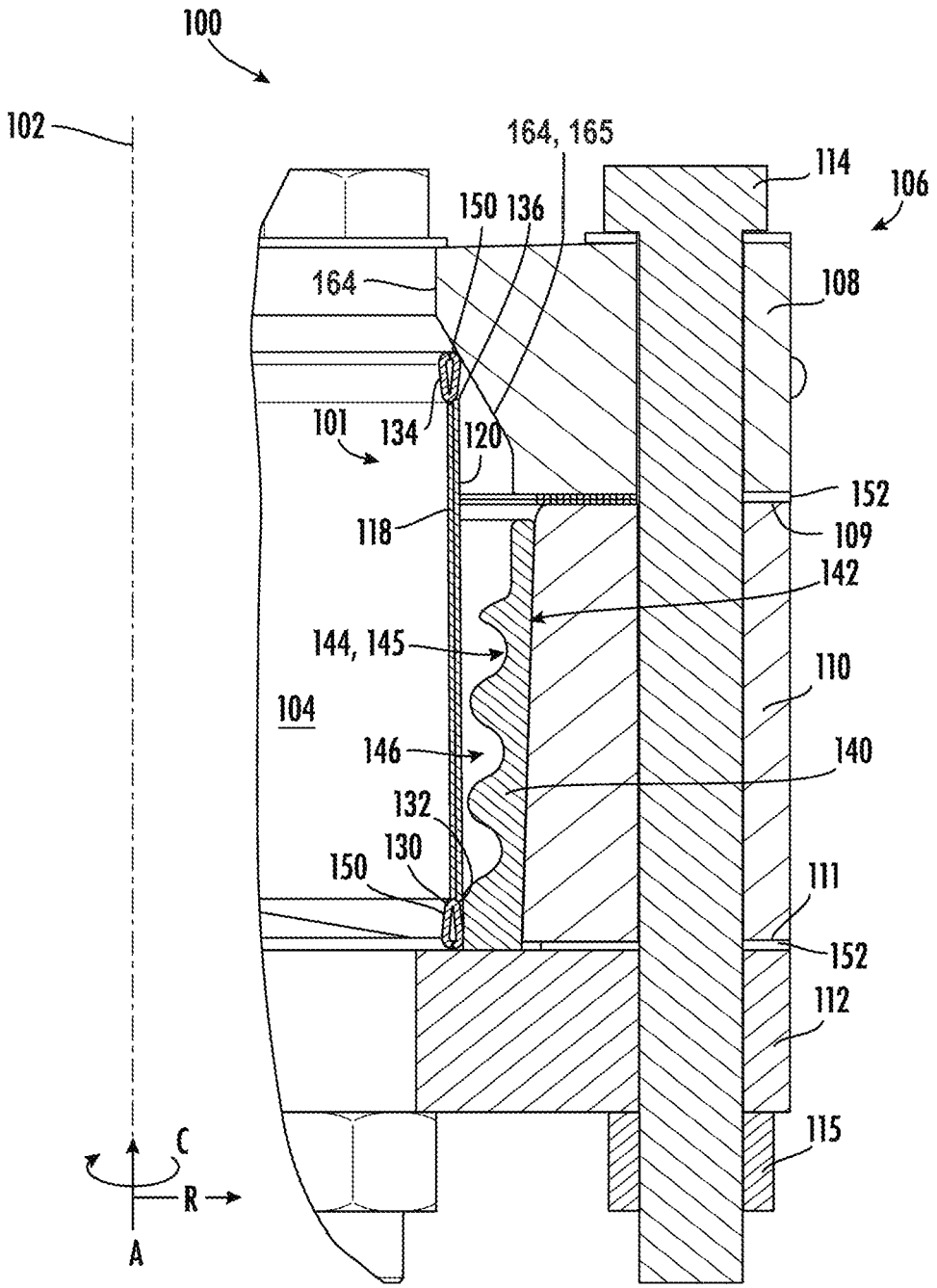
FIG. 4 is a cross-sectional view of the exemplary embodiment from along the line 4-4 shown in FIG. 2.
Figure 5:
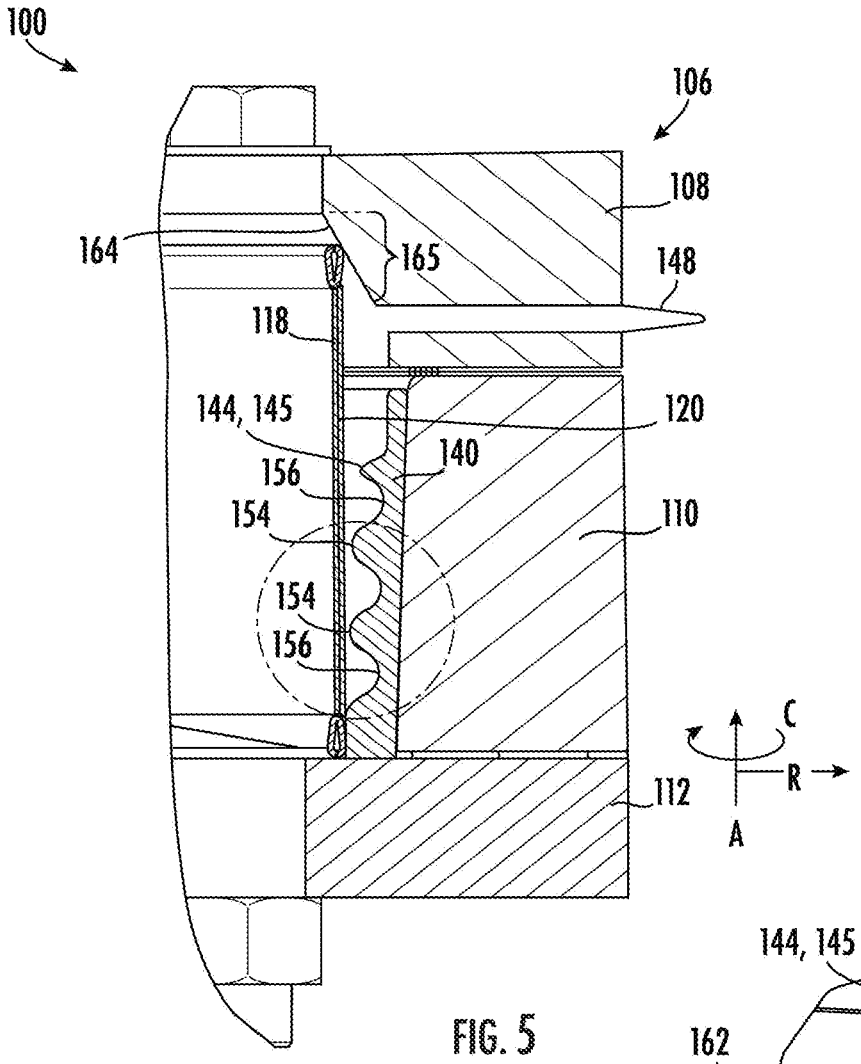
FIG. 5 is a cross-sectional view of the exemplary embodiment from along the line 5-5 shown in FIG. 2

FIG. 4 illustrates a cross-sectional view of the exemplary tooling assembly 100 shown in FIG. 2 from along the line 4-4, and FIG. 5 illustrates a cross-sectional view of the exemplary tooling assembly 100 from along the line 5-5, in accordance with embodiments of the present disclosure. As shown, the length (measured along the axial direction A) of the inner thin-walled cylinder 118 may be longer than the length of the outer thin-walled cylinder 120, thereby advantageously allowing for an easier separation of the thin-walled cylinders 118, 120 once they have been formed into helical tubes 302, 304 (FIG. 9) by the explosive formation process.

In exemplary embodiments, as shown in FIGS. 4 and 5 collectively, an annular plenum 146 may be defined between the at least one thin-walled cylinder 101, the die 140, and the casing 106. For example, the annular plenum 146 may be defined between the die 140, the inner and outer thin-walled cylinders 118, 120, a portion of the die support 110, and the tube sealing plate 108. In exemplary embodiments, a vacuum sealing port 148 (FIG. 5) may extend through the casing 106 and is in fluid communication with the annular plenum 146. In exemplary implementations, the vacuum sealing port 148 may advantageously be disposed of and configured away from the explosive charge in order to avoid damage during the explosive blast. In operation, a pump may be connected to the vacuum sealing port 146 in order to remove all the fluid (air or other fluid) from the annular plenum 146 prior to the explosive formation of the thin-walled cylinders 118, 120. In some embodiments, the tooling assembly 100 may include multiple vacuum sealing ports.

In particular embodiments, the thin-walled cylinders 118, 120 may be contained within the casing 106, e.g., axially between the tube sealing plate 108 and the base plate 112. In this way, only the radially inner surface 126 of the inner thin-walled cylinder 118 is exposed to the cavity 104, thereby being directly exposed to the explosive blast when the explosive charge 200 is detonated. In many embodiments, both the base plate 112 and the tube sealing plate 108 extend radially inward of the die support 110. For example, as shown in FIG. 4, both the base plate 112 and the tube sealing plate 108 extend radially inward beyond the die support 110, the die 140, and both the thin-walled cylinders 118, 120.

In some embodiments, the tooling assembly 100 may include one or more shims positioned in contact with one or both of the thin-walled cylinders 118, 120, in order to facilitate separation of the thin-walled cylinders 118, 120 from one another after the explosive blast. For example, the one or more shims may be positioned between the thin-walled cylinders 118, 120 or between the thin-walled cylinders and the die 140. The one or more shims may be sized to provide a clearance between components that facilitates removal of the thin-walled cylinders 118, 120 from the tooling assembly 100 after the explosive blast.

After the explosive blast of the explosive charge 200 within the cavity 104, the thin-walled cylinders 118, 120 expand radially outward and form to correspond with the shape of the die 140 and partially to the shape of a radially inner surface 164 of the tube sealing plate 108. In exemplary embodiments, the radially inner surface 164 of the tube sealing plate 108 includes a portion or sloped portion 165 that tapers radially inward in the axial direction A such that the tube sealing plate at least partially defines a frustoconical shape. For example, because the radially inner surface 164 extends annularly around the centerline 102, the resulting shape of the portion 165 that tapers radially inward is frustoconical. The sloped portion 165 is advantageous because it allows for the resulting helical tubes 302, 304 (which are formed from the thin-walled cylinders 118, 120 into the shape of the die 140 and partially the tube sealing plate 108) to include an edge making the separation of two helical tubes 302, 304 easier and that provides a welding surface. For example, the sloped portion 165 may advantageously create a corresponding sloped portion in the resulting helical tubes 302, 304, which facilitates the separation of the helical tubes 302, 304 from one another and from the casing 106.

Additionally, the sloped portion 165 of the radially inner surface 164 is advantageous because it provides an angled forming surface that ensures the thin-walled cylinders 118, 120 form smoothly by gliding, sliding, or otherwise moving along the sloped portion 165 of the surface 164 during the explosive forming process. For example, the sloped portion 165 facilitates the formation of the thin-walled cylinders 118, 120 into resulting helical tubes 302, 304 without tearing due to the high localized stress. In this way, one or more of the thin-walled cylinders 118, 120 may be in sliding contact with the sloped portion 165 of the radially inner surface 164 during the explosive formation process. In exemplary implementations, which include two or more thin-walled cylinders, only the radially innermost thin-walled cylinder may be required to contact the sloped portion 165 of the radially inner surface 164 in order to create and maintain a vacuum within the annular plenum 146.

In many embodiments, as shown, the tooling assembly 100 may include various gaskets and seals that function to prevent fluid (such as water or air) from entering an annular plenum 146 once a vacuum has been pulled. For example, the tooling assembly 100 may include one or more annular U-shaped gaskets 150 and one or more annular gaskets 152. As shown, one annular gasket 152 may be positioned between the first end 109 of the die support 110 and the tube sealing plate 108, and another annular gasket 152 may be positioned between the second end 111 of the die support 110 and the base plate 112, thereby preventing any leaks from the annular plenum 146 through the casing 106. Further, as shown, one annular U-shaped gasket 150 may be positioned on either end (e.g., the first end 130 and the second end 134) of the inner thin-walled cylinder 118. However, in other embodiments (not shown), the outer thin-walled cylinder 120 may utilize one or more U-shaped gaskets. The U-shaped gaskets 150 may advantageously "ride" or slide along the sloped portion 165 of the surface 164 during the explosive formation process, thereby ensuring that a vacuum seal is maintained within the annular plenum 146.

Figure 6:
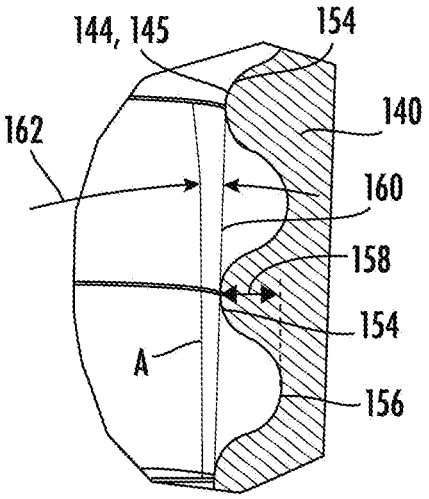
FIG. 6 is an enlarged view of the detail encircled by the dashed line in FIG. 5.

As shown in FIG. 5, the thread pattern 145 of the radially inner surface 144 of the die 140 may include alternating peaks 154 and valleys in the axial direction A. As shown in FIG. 6, which illustrates an enlarged view of the detail encircled by the dashed line in FIG. 5, the distance 158 (measured in the radial direction R) may be defined between a peak 154 and a valley 156 of the thread pattern 145 that is between about 0.25 inches and about 1 inches. In some embodiments, the distance 158 may be between about 0.25 inches and about 0.75 inches. In particular embodiments, the distance 158 may be between about 0.3 inches and about 0.6 inches. Once the thin-walled cylinders 118, 120 are formed to correspond with the die 140, they will define a similar distance which will provide an increased strength to drop-tests when compared to prior designs.

In exemplary embodiments, as shown best in FIG. 6, the radially inner surface 144 of the die 140 tapers radially outward in the axial direction A. For example, the radially inner surface 144 of the die 140 may taper radially outward as the die 140 extends in the axial direction, thereby increasing the distance between the radially inner surface 144 of the die 140 and the outer thin-walled cylinder 120 in the axial direction. As is understood, once the thin-walled cylinders 118, 120 are formed into helical tubes 302, 304 (FIG. 9) that correspond to the shape of the die 140, they will also taper radially outward in the axial direction. This advantageously allows the inner helical tube 302 to be separated from the outer helical tube 304 with ease.

For example, as shown in FIG. 6, a taper axis 160 may be defined between two peaks 154 of the thread pattern 145. The taper axis 160 may form an angle 162 with the axial direction A that is up to about 10°. In other embodiments, the taper axis 160 may form an angle 162 with the axial direction A that is up to about 5°. In particular embodiments, the taper axis 160 may form an angle 162 with the axial direction A that is up to about 3°. The angle 162 is imparted on the inner helical tube 302 and the outer helical tube 304 after the explosive blast, which advantageously allows for a positive mechanical engagement when the inner helical tube 302 and the outer helical tube 304 are screwed together (or threadably coupled together).

FIG. 7 illustrates at least one thin-walled cylinder 101 (or tube blank) next to a finished helical tube 300, which has undergone a method of explosively forming at least one thin-walled cylinder 101 into a helical tube 300 using a tooling assembly 100 described below (e.g., method 800). As shown, and described, after the explosive blast of the explosive charge 200, the thin-walled cylinder 101 expands radially outward and forms to the shape of the die 140 and at least a portion of the tube sealing plate 108, thereby becoming the helical tube 300.

Figure 8:
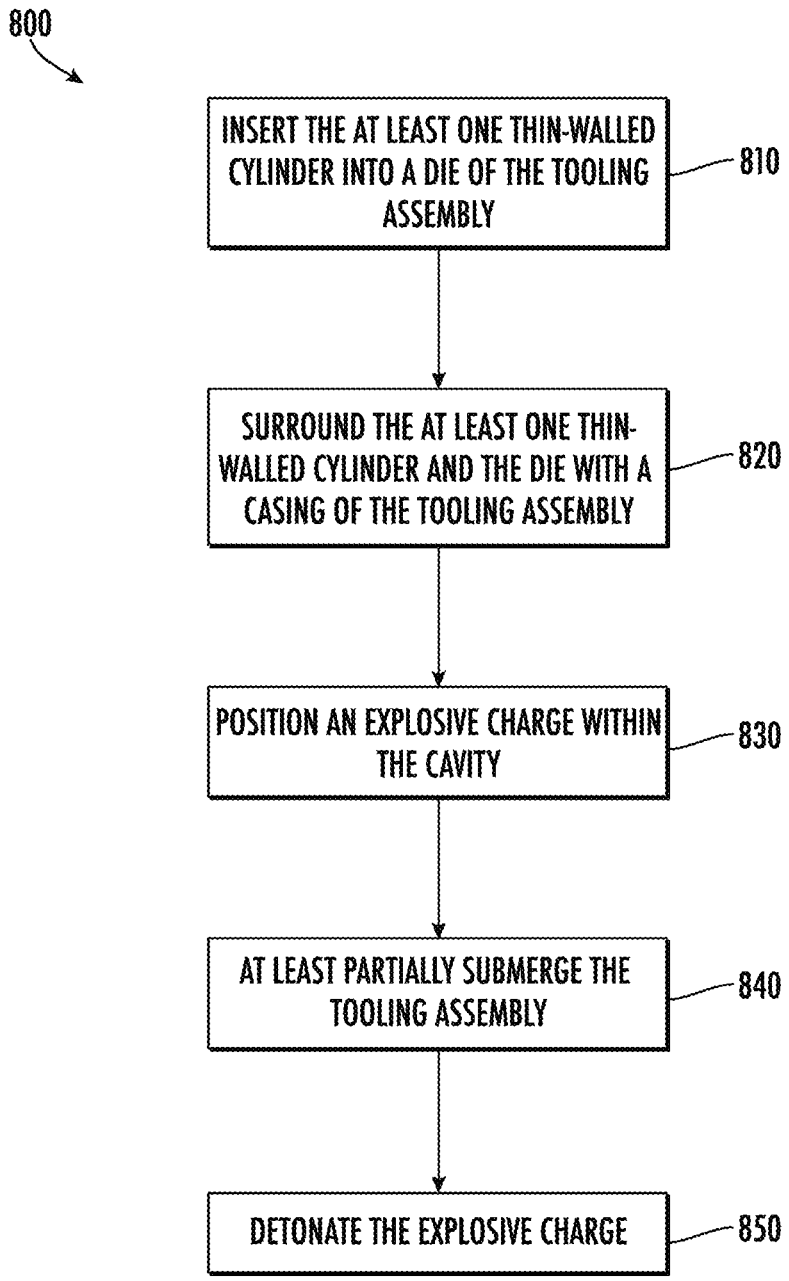
FIG. 8 illustrates a flow chart of a method of explosively forming a helical tube from at least one thin-walled cylinder using a tooling assembly.

FIG. 8 is a flow chart of a sequential set of steps 810 through 850, which define a method 800 of explosively forming a helical tube 300 from at least one thin-walled cylinder 101 using a tooling assembly 100, in accordance with embodiments of the present disclosure. As shown, the method includes a step 810 of inserting the at least one thin-walled cylinder 101 (such as the inner thin-walled cylinder 118 and the outer thin-walled cylinder 120) into a die 140 of the tooling assembly 100. As described above, the die 140 surrounds the at least one thin-walled cylinder 101 and includes an interior surface 144 that defines a helical thread pattern 145.

The method 800 further includes a step 820 of surrounding the at least one thin-walled cylinder 101 and the die 140 with a casing 106 of the tooling assembly 100. As shown in FIGS. 1-4, a cavity 104 may be defined by the casing 106 and the at least one thin-walled cylinder 101. More specifically, as described above, the casing 106 may include a tube sealing plate 108, a die support 110, and a base plate 112. In many embodiments, the surrounding step 820 may further include positioning the second end 111 of the die support 110 on the base plate 112. Further, the surrounding step 820 may include placing the die 140 and the at least one thin-walled cylinder 101 onto the base plate 112 and into the die support 110. For example, the die 140 (and/or the at least one thin-walled cylinder 101) may be inserted into the die support 110 after the die support has been positioned on the base plate 112. Finally, the surrounding step 820 may further include positioning the tube sealing plate 108 on the first end 109 of the die support 110.

Optionally, the method 800 may further include positioning at least one annular gasket 152 between die support 110 and one of the base plate 112 and the tube sealing plate 108. The annular gasket 152 may function to prevent fluid from entering the annular plenum 146. For example, as shown in FIG. 4, an annular gasket 152 may be positioned on either end 109, 111 of the die support 110 (e.g., between the die support 110 and the tube sealing plate 108 and between the die support 110 and the base plate 112). Similarly, the method 800 may include placing an annular U-shaped gasket 150 onto an end (130 and/or 134) of the at least one thin-walled cylinder 101 (FIG. 4). The U-shaped gasket(s) 150 may function to advantageously decrease leaks and maintain the vacuum within the annular plenum 146.

Once the casing 106 is assembled to surround the at least one thin-walled cylinder 101 and the die 140, the method 800 may further include installing a plurality of bolts 114 and fasteners 115 through the tube sealing plate 108, the die support 110, and the base plate 112. For example, the plurality of bolts 114 may be circumferentially spaced apart from one another and may each extend generally axially through the casing 106. In particular embodiments, the casing 106 may include a tube sealing plate 108, a die support 110, and a base plate 112. The plurality of bolts 114 may extend through the tube sealing plate 108, the die support 110, and the base plate 112, and the corresponding fasteners 115 may threadably couple to the bolts 114 in order to couple the components of the casing 106 to one another.

In exemplary embodiments, the method 800 may further include step 830 of positioning an explosive charge 200 (such as dynamite or other suitable explosive) within the cavity 104. In some embodiments, the explosive charge 200 may be positioned along the axial centerline 102 of the tooling assembly such that the force from the resulting blast is uniformly distributed onto the at least one thin-walled cylinder 101. As shown in FIG. 2, the explosive charge 200 may be held in place by one or more supports 202 that couple to the casing 106 (such as to the axially outer surface of the tube sealing plate 108). The supports 202 may be positioned such that they secure the explosive charge 200 to the tooling assembly 100 without creating an impediment that could block or break up the force from the explosive blast.

In various embodiments, the method 800 may include a step of removing via one or more vacuum sealing ports 148 that may extend through the casing air within an annular plenum 146 defined between the at least one thin-walled cylinder 101, the casing 106, and the die 140. The vacuum sealing port may extend through the casing in a variety of manners and advantageously allows a vacuum to be pulled within the annular plenum 146 prior to the detonation of the explosive charge 200.

As shown in FIG. 8, the method 800 may further include a step 840 of at least partially submerging the tooling assembly 100. For example, the tooling assembly 100 may be submerged (either entirely or partially) in a body of liquid (such as water or other suitable fluid), such that the explosive blast of the explosive charge 200 is contained within a controlled environment. For example, submerging the tooling assembly 100 within a liquid allows the forces from the explosive blast to be directed to the forming of the at least one thin-walled cylinder, while also allowing excess pressure to be dissipated by pushing the liquid axially out of the assembly. In various implementations, the tooling assembly 100 may be submerged at various depths within the liquid (e.g., the deeper the tooling assembly is submerged, the greater the forces of the liquid). Further, submerging the tooling assembly 100 may allow for the helical tube(s) 302, 304 to be rapidly cooled after being formed by the explosion, which may impart advantageous properties (such as increased strength) on the material of the helical tube(s) 302, 304 (e.g., metal, ceramics, or other suitable material).

In exemplary embodiments, the method 800 may further include a step 850 of detonating the explosive charge 200. As a result, the at least one thin-walled cylinder 101 may be formed into a helical tube 300 that corresponds with helical thread pattern 145 of the interior surface 144 of the die 140. More specifically, as a result of the explosive blast of the explosive charge 200, the at least one thin-walled cylinder 101 may be formed into a helical tube 300 that corresponds with helical thread pattern 145 of the interior surface 144 of the die 140 and at least a portion of the radially inner surface 164 of the support tube 108.

Figure 9:
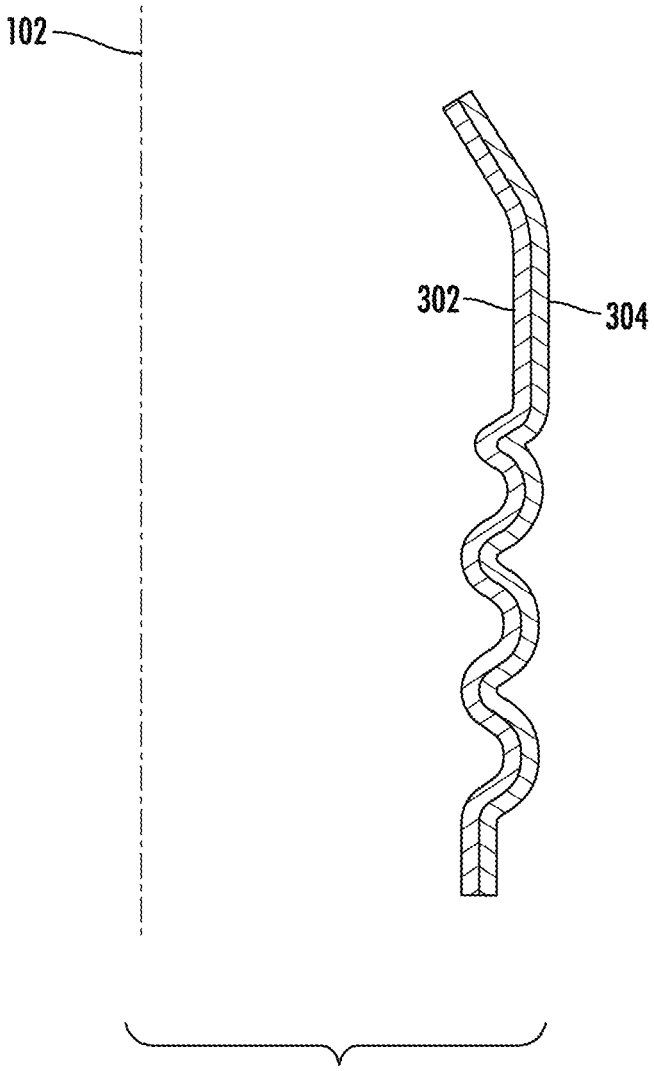
FIG. 9 is cross section of an inner helical tube coupled to an outer helical tube.

In particularly advantageous embodiments, the at least one thin-walled cylinder 101 may include an inner thin-walled cylinder 118 and an outer thin-walled cylinder 120 that are concentric with one another (e.g., share an axial centerline, such as the axial centerline 102 of the tooling assembly). In such embodiments, detonating the explosive charge 200 may result in both the inner thin-walled cylinder 118 and the outer thin-walled cylinder 120 being simultaneously formed into an inner helical tube 302 and an outer helical tube 304 that both correspond with the helical thread pattern 145 of the interior surface 144 of the die 140 and at least a portion of the tube sealing plate 108. For example, FIG. 9 illustrates a cross-section of an inner helical tube 302 threadably coupled to an outer helical tube 304 which have been removed from the tooling assembly 100 following the explosive blast and formation thereof. Although FIG. 9 illustrates a cross-section of the helical tubes 302, 304, the helical tubes 302, 304 may extend annularly around the axial centerline 102 and may be threadably coupled to one another after the explosive blast. In this way, the inner helical tube 302 may be rotatably removed from the outer helical tube 304 (or vice versa).

In optional embodiments, the method 800 may further include a step of separating the inner helical tube 302 from the outer helical tube 304 after detonating the explosive charge 200 by rotating one of the inner helical tube 302 or the outer helical tube 304 relative to the other of the inner helical tube 302 or the outer helical tube 304. In this way, the helical tubes 302, 304 may be coupled and uncoupled to one another via rotation due to the threaded relationship between the helical tubes 302, 304.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of explosively forming a helical tube from at least one thin-walled cylinder using a tooling assembly, the method comprising the steps of:

inserting the at least one thin-walled cylinder into a die of the tooling assembly, the die surrounding the at least one thin-walled cylinder and comprising an interior surface that defines a helical thread pattern having peaks and valleys, wherein a taper axis is defined between two peaks of the thread pattern, and wherein the taper axis diverges radially outwardly as the die extends axially outwardly;

surrounding the at least one thin-walled cylinder and the die with a casing of the tooling assembly, wherein a cavity is defined by the at least one thin-walled cylinder and extending along an axial centerline of the tooling assembly;

positioning an explosive charge within the cavity;

at least partially submerging the tooling assembly; and detonating the explosive charge, whereby the at least one thin-walled cylinder is formed into a helical tube that corresponds with helical thread pattern of the interior surface of the die.

2. The method as in claim 1, wherein the at least one thin-walled cylinder comprises an inner thin-walled cylinder and an outer thin-walled cylinder that are concentric with one another, and wherein detonating the explosive charge results in both the inner thin-walled cylinder and the outer thin-walled cylinder being simultaneously formed into an inner helical tube and an outer helical tube that both correspond with the helical thread pattern of the interior surface of the die.

3. The method as in claim 2, further comprising:

separating the inner helical tube from the outer helical tube after detonating the explosive charge by rotating one of the inner helical tube or the outer helical tube relative to the other of the inner helical tube or the outer helical tube.

4. The method as in claim 1, wherein the casing comprises a die support extending between a first end and a second end, a base plate, and a tube sealing plate.

5. The method as in claim 4, wherein the surrounding step further comprises:

positioning the second end of the die support on the base plate;

placing the die and the at least one thin-walled cylinder onto the base plate and into the die support; and positioning the tube sealing plate on the first end of the die support.

6. The method as in claim 5, further comprising:

installing a plurality of bolts and fasteners through the tube sealing plate, the die support, and the base plate.

7. The method as in claim 4, further comprising:

positioning at least one annular gasket between die support and one of the base plate and the tube sealing plate.

8. The method as in claim 1, further comprising:

removing, via one or more vacuum sealing ports extending through the casing, air within an annular plenum defined between the at least one thin-walled cylinder, the casing, and the die.

9. The method as in claim 1, further comprising:

placing an annular U-shaped gasket onto an end of the at least one thin-walled cylinder.

10. A tooling assembly for explosively forming a helical tube from at least one thin-walled cylinder, the tooling assembly defining an axial, radial, and circumferential direction, the tooling assembly comprising:

a casing that surrounds the at least one thin-walled cylinder, the casing including a die support that extends from a first end to a second end and a tube sealing plate coupled to the first end of the die support, wherein the tube sealing plate converges radially inward in the axial direction, and wherein the at least one thin-walled cylinder defines a cavity extending along an axial centerline of the tooling assembly; and a die positioned within the casing, the die having a radially outer surface in contact with the die support of the casing and a radially inner surface that defines a helical thread pattern having peaks and valleys, wherein a taper axis is defined between two peaks of the thread pattern, and wherein the taper axis diverges radially outwardly as the die extends axially outwardly.

11. The tooling assembly as in claim 10, wherein the radially inner surface of the die tapers radially outward in the axial direction.

12. The tooling assembly as in claim 11, wherein the radially inner surface of the die forms an angle with the axial direction that is up to 10°.

13. The tooling assembly as in claim 10, wherein the tube sealing plate includes a radially inner surface having a portion that tapers radially inward in the axial direction such that the tube sealing plate at least partially defines a frustoconical shape.

14. The tooling assembly as in claim 10, wherein the distance between a peak and a valley of the thread pattern is between 0.25 inches and 1 inches.

15. The tooling assembly as in claim 10, wherein the casing further comprises a base plate coupled to the second end of the die support.

16. The tooling assembly as in claim 15, wherein both the base plate and the tube sealing plate extend radially inward of the die support.

17. The tooling assembly as in claim 10, further comprising a plurality of bolts circumferentially spaced apart from one another and extending generally axially through the casing.

18. The tooling assembly as in claim 10, wherein an annular plenum is defined between the at least one thin-walled cylinder, the die, and the casing, and wherein a vacuum sealing port extends through the casing and is in fluid communication with the annular plenum.

* * * * *